United States Patent [19]

Grilli et al.

[11] Patent Number: 4,495,004

[45] Date of Patent: Jan. 22, 1985

[54] PROCESS FOR HIGH-TEMPERATURE CARBURIZING TREATMENT OF TRACK BUSHES FOR TRACTORS OR TRACKED VEHICLES

[75] Inventors: Walter Grilli; Franco De Meo; Ivan Franchini, all of Modena, Italy

[73] Assignee: Italtractor ITM SpA, Castelvetro, Italy

[21] Appl. No.: 543,727

[22] Filed: Oct. 20, 1983

[51] Int. Cl.[3] ..... C23C 11/10

[52] U.S. Cl. ..... 148/16.5; 148/36

[58] Field of Search ..... 148/16.5, 36

[56] References Cited

U.S. PATENT DOCUMENTS

| | | | |
|---|---|---|---|
| 3,227,586 | 1/1966 | Spencer | 148/36 |
| 4,152,177 | 5/1979 | Mantel | 148/16.5 |

FOREIGN PATENT DOCUMENTS

| | | |
|---|---|---|
| 632935 | 3/1932 | Fed. Rep. of Germany . |
| 2710748 | 1/1981 | Fed. Rep. of Germany . |
| 1489106 | 10/1977 | United Kingdom . |

OTHER PUBLICATIONS

L. B. Efimova et al., Metal Science & Heat Treatment, vol. 21, No. 7-8, pp. 609-611, Jul.-Aug. 1979.

*Primary Examiner*—Veronica O'Keefe

*Attorney, Agent, or Firm*—Young & Thompson

[57] ABSTRACT

Process for the production of track bushes for tractors and track vehicles, with resultant savings in energy, shorter treatment times and consistently high product quality. A plurality of low carbon boron steel bushes are assembled as a charge in a basket. The charge is preheated in a pretreatment chamber of a furnace having a carburizing chamber, with combustion gases from the carburizing chamber. Then the charge is transferred to this carburizing chamber, and is carburized at a temperature in excess of 900° C., preferably 950° to 980° C., for 10 to 17 hours. The charge is cooled in a third chamber of this furnace, to a temperature of 820°-860° C. maintained by means of combustion gas leaving the carburizing chamber. The bushes are extracted from the charge one at a time by a robot and are directly individually quenched. The ends of the bushes are tempered in an induction furnace at 550°-600° C. for 10 to 25 seconds, and then the bushes are emulsion cooled. The bushes are totally stress relieved for 1-2 hours at 180°-200° C. in a continuous furnace fed by hot waste gases from the first-mentioned furnace.

8 Claims, No Drawings

PROCESS FOR HIGH-TEMPERATURE CARBURIZING TREATMENT OF TRACK BUSHES FOR TRACTORS OR TRACKED VEHICLES

This invention relates to the production of bushes for the tracks of tracked vehicles in general, such as tractors and earth-moving machinery. More precisely, the invention refers to a production process in which the bushes are carburized at high temperature in a carburizing atmosphere produced in situ (using techniques which are already known as such but which have never been applied simultaneously to the items in question), and then are individually quenched and finally undergo a tempering of the ends and a total stress relief.

The bush, rotatably coupled to a pin, forms the articulated junction element between the track links.

During the relative movement between two connected track elements the pin rotates inside the bush with sliding friction and is subject to high dynamic loads applied directly to the bush by the driving sprocket. The variable temperatures under which earth-moving machinery operates further increase the stress on the bushes.

The technological properties the bush must have in order to withstand such use conditions include high surface hardness combined with good tensile strength, good fatigue strength and good impact strength.

These properties are ensured by specifications that call for a completely martensitic structure in the center and on the surface, 5–8 ASTM austenitic grain, surface hardness in excess of 55 HRC, center hardness of 32–44 HRC and surface hardness at the ends of 35–46 HRC.

These requisites are obtainable by using a low-carbon steel (0.13–0.24% C) containing boron (0.0005–0.003% B) with 0.60–0.90% Mn and 0.10–0.30% Si, both for the extrusion and for the machining processes of manufacture. Other elements such as aluminum, for instance, are preferably added in the quantities normally required for the purpose of inhibiting the growth of austenitic grain size during high-temperature carburizing. However, the above steel composition is not a limiting factor as regards this invention; indeed, any steel capable of meeting the technical requirements indicated earlier is suitable for treatment by the present invention.

Attainment of the desired mechanical properties is an essential condition for the production of parts, such as bushes, subject to wear and decidedly unusual stresses, when in use. For these reasons, although a number of treatments of great interest from the technical and economic standpoint were already known, such as high-temperature carburizing and direct quenching, it had hitherto been considered impossible or anyway too complicated and costly to apply them to the production of track bushes for tracked vehicles (henceforth simply referred to as bushes). In fact, with the higher temperatures involved in high-temperature carburizing, not only is there the risk of uncontrolled grain growth (a risk that in the case in point is controlled by the special inhibitors mentioned above), but also there is the risk that they may create temperature profiles and hence stresses in the pieces during cooling, such as result in distortion and rupture or at least lead to lack of unifomity of properties. Then again, direct quenching, which uses the residual carburizing heat, performed hitherto either on very small parts, treated en massse or even sometimes on large parts, treated singly right from the carburizing heat phase, seemed difficult to apply to parts such as bushes, which are too small to be suitable for individual treatment right from the carburizing process, but too large to support direct quenching treatment en masse, since any differences in packing them into the baskets can easily cause differences in cooling rates and hence in the mechanical properties, between spaced parts of the bush or between the outer and inner surfaces thereof.

Up to now, the bush-manufacture cycle has generally been as follows:

- heating of the bushes and holding them at a temperature between 900° and 930° C. in pit carburizing furnaces fed with methane and carburizing gas, known as endogas, produced in external catalytic generators burning methane. Treatment time is generally between 24 and 36 hours;
- slow cooling in a carburizing furnace to about 600° C.;
- transfer to a suitable chamber for further cooling to about 300° C.;
- air cooling to room temperature;
- heating of the bushes to 820°–860° C.;
- quenching of the bushes in a water-oil emulsion;
- tempering of the ends at 550°–600° C. in an induction furnace and subsequent cooling to obtain a surface hardness of 35–46 HRC;
- total stress releieving in a soaking pit at 180°–200 PC for 1–2 hours.

The complexity of the cycle is evident, particularly its effect on the cost because of the treatment times and the four heatings, three of which are to high temperature.

Recent events which caused such a vertiginous rise in energy costs have resulted in a very decided deterioration in the situation. However, it does not appear that any significant changes have occurred so far in the specific field of bush manufacture.

The object of this invention is to simplify and reduce the cost of making bushes through a series of measures aimed at simplifying the plant, reducing carburizing times, eliminating the heating for quenching and reducing energy consumption, particularly as regards methane.

The present invention provides for the use of techniques that, although individually known, such as high-temperature carburizing with furnace-produced atmosphere and direct quenching, are applied in an original manner to a product such as bushes and incorporated for the first time simultaneously in an optimized treatment cycle.

The procedure for the manufacture of track bushes per this invention is characterized by the sequential combination of the following operations:

Preheating of the charge to 800°–900° C. in a treatment chamber of a furnace fed by the combustion gases extracted from the carburizing chamber;

Transferring the charge to the carburizing chamber fed directly with methane and air only, raising the temperature of the charge to above 900° C., preferably between 950 and 980° C., holding at that temperature for the time required to obtain the desired charaburizing depth, typically around 10–17 hours for a depth of between 2 and 3 mm;

Cooling of the charge in a cooling chamber of the furnace, bringing the temperature down to between 820° and 850° C. where it is held by means of gases coming from the carburizing chamber;

Extraction of the bushes one at a time from the cooling chamber by robot and direct quenching them;

Tempering of the ends of the bushes for 10 to 25 seconds at 550°–600 ° C., followed by emulsion cooling to obtain the desired hardness of 35–45 HRC and finally total stress relieving them in a continuous furnace at 180°–200° C. for 1–2 hours utilizing the residual heat of the gases leaving the treatment furnace (carburizing and cooling zones).

Although this manufacturing cycle certainly utilizes known steps, they have never been used in this combination, or to make bushes, where the need to save energy and to operate rapidly is particularly great owing to the low-cost nature of the product.

EXAMPLE

A series of charges of bushes, each charge weighing 2000 Kg, all of the same type of steel, was preheated to 850° C. in an above-identified treatment chamber, and was then transferred to an above-identified carburizing chamber where, as explained above, it was heated at 950° C. and 980° C. to obtain carburizing depths of between 2 and 3 mm. The composition of the steel, in weight per cent, was as follows:

| | |
|---|---|
| C | 0.19 |
| Mn | 0.8 |
| Si | 0.25 |
| Cr | 0.2 |
| B | 0.003 |

balance essentially iron.

The individual bushes were identical to each other and were hollow cylinders each having a length of 150 mm, an outside diameter of 60 mm, and an inside diameter of 40 mm. The treatment times were then varied, while the other parameters remained the same for each charge, namely: quench temperature 850° C.; tempering of ends in an induction furnace for 15 seconds at 570° C., stress relieving for two hours at 180° C.

The results obtained can be summarized as follows:

Carburizing temperature: 950° C.
Carburizing time (steady state): 12 hours
Quench temperature: 850° C.
Tempering: 2 hours at 180° C.
Austenitic grain: 5.5 at the center, 7 in the carburized layer (ASTM)
Structure: martensitic
Surface hardness: 60 MRC
Center hardness: 41 MRC
Surface hardness of ends: 40 HRC
Effective depth at 50 HRC: 2.2 mm
Carburizing temperature: 980° C.
Carburizing time (steady state): 10 hours
Quench temperature: 850° C.
Tempering: 2 hours at 180° C.
Austenitic grain: 5 at the center and 7 in the carburized layer (ASTM)
Structure: martensitic in the center; martensitic with residual austenite in the carburized zone
Surface hardness: 61 HRC
Center hardness: 42 HRC
Surface hardness of ends: 41 HRC
Effective depth at 50 HRC: 2.5 mm The combination of specific techniques selected—furnace produced carburizing atmosphere and direct quenching—and the high recovery of residual heat from the carburizing gas, permits an energy saving in excess of 200 $Nm^3$ of methane per ton of charge, equal to 40% of the energy consumption for an identical treatment using endogas, and this despite the higher carburizing temperature. The saving in time is also marked. Indeed, if a carburizing depth of about 2.5 mm is chosen, with the traditional carburizing temperatures between 900° and 930° C. the carburizing time ranges from 20 to 30 hours, which is almost twice that needed with the process of the present invention.

What is claimed is:

1. Process for the production of track bushes for tracked vehicles, from low-carbon boron steel, having a martensitic structure in the center and on the surface, with 5–8 ASTM austenitic grain, center hardness between 32 and 44 HRC, surface hardness over 55 HRC and hardness of ends between 35 and 46 HRC, comprising forming a charge comprised by a plurality of bushes in a basket, and subjecting the charge to the following sequential operations:

preheating the charge in a pretreatment chamber of a furnace having a carburizing chamber, with combustion gases from said carburizing chamber;

transferring the charge to said carburizing chamber, where the carburizing atmosphere is produced in situ, and there carburizing the charge at a temperature in excess of 900° C.;

cooling the charge in a third chamber of said furnace, to a temperature of 820°–850° C., maintained by means of combustion gas leaving said carburizing chamber;

extracting bushes from the charge one at a time by a robot and directly individually quenching the extracted bushes;

tempering the ends of the bushes and emulsion cooling the bushes; and total stress relieving the bushes for 1–2 hours at 180°–200° C. in a continuous furnace fed by hot waste gases from the first-mentioned furnace.

2. Process as claimed in claim 1, in which the carburizing temperature is about 950° to 980° C.

3. Process as claimed in claim 1, in which the quench temperature of the bushes is between 820° and 850° C.

4. Process as claimed in claim 1, in which after direct quenching of the bushes the ends of the bushes are tempered in an induction furnace at a temperature of 550°–600° C.

5. Process as claimed in claim 4, in which said tempering time is 10 to 25 seconds.

6. Process as claimed in claim 1, in which said preheating temperature is 800°–900° C.

7. Process as claimed in claim 1, in which the carburizing time is about 10 to 17 hours.

8. Process as claimed in claim 1, in which said steel has a weight per cent composition of 0.13–0.24 carbon, 0.0005–0.003 boron, 0.60–0.90 Mn and 0.10–0.30 Si, balance essentially iron.

* * * * *